US006055915A

United States Patent [19]

Bickell et al.

[11] Patent Number: 6,055,915

[45] Date of Patent: May 2, 2000

[54] WOOD RESIDUE DISPOSAL SYSTEM

[76] Inventors: Roy A. Bickell, Box 1059, Grande Prairie, Alberta, Canada, T8V 4B5; Tjeerd E. Vanderveen, 18 Lake View Estates, Grande Prairie, Alberta, Canada, T8V 2Z9

[21] Appl. No.: 08/832,879

[22] Filed: Apr. 4, 1997

[51] Int. Cl.[7] ..... F23N 5/18; F23N 5/00; F23N 5/20; F23N 5/22

[52] U.S. Cl. ..... 110/186; 110/101 CA; 110/101 CD; 110/101 CF; 110/185; 110/190; 110/191; 110/192; 110/219; 110/220; 110/222; 110/342

[58] Field of Search ..... 110/101 C, 101 CA, 110/101 CD, 101 CF, 185, 186, 188, 190, 191, 192, 218, 219, 220, 222, 341, 342, 346, 347, 348

[56] References Cited

U.S. PATENT DOCUMENTS

| | | | |
|---|---|---|---|
| 1,936,810 | 11/1933 | Upson . | |
| 3,826,208 | 7/1974 | Williams . | |
| 3,831,535 | 8/1974 | Baardson | 110/186 |
| 4,015,548 | 4/1977 | Schuss | 110/101 C |
| 4,044,695 | 8/1977 | Mackenzie et al. | 110/220 |
| 4,047,489 | 9/1977 | Voorheis et al. | 110/342 |
| 4,235,174 | 11/1980 | Spurrell | 110/346 |
| 4,311,102 | 1/1982 | Kolze et al. | 110/103 |
| 4,419,941 | 12/1983 | Santalla | 110/232 |
| 4,431,405 | 2/1984 | Eatherton | 432/72 |
| 4,489,664 | 12/1984 | Williams | 110/186 |
| 4,517,903 | 5/1985 | Richmond et al. | 110/233 |
| 4,589,356 | 5/1986 | Adams et al. | 110/347 |
| 4,589,357 | 5/1986 | Lincoln et al. | 110/347 |
| 4,628,833 | 12/1986 | O'Hagan et al. | 110/263 |
| 4,744,311 | 5/1988 | Piekos | 110/108 |
| 4,953,474 | 9/1990 | Armitage | 110/101 CD |
| 5,207,176 | 5/1993 | Morhard et al. | 110/246 |
| 5,339,751 | 8/1994 | Tutt | 110/186 |
| 5,425,316 | 6/1995 | Malone | 110/190 |

FOREIGN PATENT DOCUMENTS

| | | | |
|---|---|---|---|
| 1210995 | 9/1986 | Canada . | |
| 2055552 | 5/1992 | Canada . | |
| 2112740 | 11/1993 | Canada . | |
| 2 484 615 | 12/1981 | France | 110/101 C |
| 2 584 480 | 1/1987 | France | 110/186 |
| 219 560 A1 | 3/1985 | Germany | 110/101 CF |
| 58-168807 | 10/1983 | Japan | 110/101 CD |
| 1064077 | 12/1983 | U.S.S.R. | 110/220 |

*Primary Examiner*—Ira S. Lazarus
*Assistant Examiner*—Ljiljana V. Ciric
*Attorney, Agent, or Firm*—Oyen Wiggs Green & Mutala; Lawrence A. Maxham

[57] ABSTRACT

A method of wood waste disposal which regulates factors such as the amount of wood residue being fed to an incinerator at any given time so that wood residue from a mill is processed promptly and efficiently without compromising the efficient operation of the incinerator. The wood residue is separated into at least two fractions, the first fraction being directed to a storage bin for later use as required, and the second fraction being directed to the incinerator. During periods of slack feed of the second fraction to the incinerator, portions of the first fraction, as required, are directed to the incinerator as make-up, in order to maintain an optimal range of incinerator conditions by manipulating the volume and flow of wood residue in cooperation with manipulating other factors.

17 Claims, 4 Drawing Sheets

WOOD RESIDUE DISPOSAL SYSTEM

FIELD OF THE INVENTION

This invention relates to a novel improved method of wood waste disposal. More particularly, this invention pertains to a novel semi-independent system for disposing of wood residue obtained from a forest industry solid wood products manufacturing mill.

BACKGROUND OF THE INVENTION

Historically, in the forest resource industry, there has been a problem in disposing of wood residue generated by a solid wood products processing mill in manufacturing its solid wood products such as beams, timbers, planks, boards and planed products. Traditionally, wood residue such as sawdust, wood chips, bark, log ends, shavings, knots, and the like, have been disposed of by burning the wood residue directly as is and in the volumes as it is produced by the wood manufacturing process in an incinerator known in the trade as a "TeePee burner". TeePee burners are old fashioned, highly inefficient, perform poorly and generate noxious gases and ash products. TeePee burners continue to be used but are now tolerated mainly in rural areas. Even so, there is some reluctance to force their replacement with other more efficient and expensive incinerators (such as OLIVINE ™) due to the fact that even an OLIVINE incinerator cannot meet most current government enacted environmental standards.

Due to the enactment of more stringent air pollution regulations by the Department of Environment, among others, and the required phasing out of existing inefficient waste wood product burners not meeting those regulations, such as TeePee burners, new apparatus and new methods of residue handling/incineration or recovery for useful products are required. Even so, a problem remains with what should be done to improve the efficiency of existing burners. One way is to control the rate of wood residue feed to incinerators to allow them to function more efficiently rather than to be constantly overfed or under-fed due to variances in mill waste production and stoppages for lunches, coffee breaks, breakdowns, periods between shifts, the graveyard period, and the like.

A number of patents disclose various designs of systems for feeding fuel to fire burners or controlling waste disposal.

U.S. Pat. No. 4,489,664, granted Dec. 25, 1984, Williams, discloses a closed loop fuel feeding system for multiple direct fired burners. A conduit system is associated with a fuel grinding mill to form a closed loop for conducting the flow of fuel and air back to the mill in excess of the fuel and air not released from the conduit system to the burners. The system is designed to be used with finely ground coal. The closed loop circulation system enables the finely ground coal to be fed to a plurality of direct fired burners in relation to burner capacity to consume the fuel.

U.S. Pat. No. 5,425,316, granted Jun. 20, 1995, Malone, discloses a waste disposal system that has a first combustion chamber for incinerating waste material to produce ash and exhaust containing gases and particulate matter, and a second combustion chamber for firing the exhaust containing gases and particulate matter. The system also includes a plurality of sub-systems working in cooperation with the first and second combustion chambers, and a control system to control the sub-systems to ensure a desired level of incineration of the waste in the first and second combustion chambers. The control system includes sensors disposed throughout the waste disposal system, and a central controller that continuously monitors the measured conditions and compares each of the measured conditions to a predetermined performance range.

Canadian Patent No. 1,210,995, granted Sep. 9, 1986, Caffyn et al., discloses an incineration system which includes a rotary primary oxidation chamber and a secondary oxidation chamber or after burner which receives gaseous products of combustion from the primary chamber. The primary oxidation chamber is a horizontally disposed rotary drum. The secondary oxidation chamber is vertically disposed. The secondary oxidation chamber includes baffles for blocking the flow of gases and other products of combustion from the lower portion of the primary oxidation chamber into the secondary oxidation chamber.

Canadian Patent No. 2,055,552, granted May 21, 1992, Morhard et al., discloses a hazardous waste incinerator which includes a rotary kiln which is comprised of six retort sections. The combusted waste is separated into ash and recoverable metals. Air flow is countercurrent to the flow of waste through the kiln. The exhaust gases are vented from the kiln entrance. The incinerator includes a secondary combustor to ensure destruction of any principal organic hazardous constituents. The incinerator also includes a control system. The control system is made up of a program-control processor unit which is connected by an optical/electrical interface to an optical data highway loop with parametric sensors for each sub-system.

Canadian Patent No. 2,112,740, granted Nov. 25, 1993, Lautenschlager et al., discloses a process for regulating the quantity of refuse to a refuse incinerator which disposes refuse and processes recyclable materials. The incinerator is designed to reduce and eliminate harmful or toxic substances such as exhaust gases and particulate such as flue dust and ashes in the exhaust gases. The system is designed to maintain approximately constant operating conditions during the incineration process. The system is intended to keep the amount of refuse delivered to or the depth of the refuse layer on a combustion grate approximately constant, regardless of net calorific value, and to prevent overloading or underloading of the grate.

SUMMARY OF THE INVENTION

The invention is directed to a process of efficiently disposing of wood residue from a solid wood product manufacturing mill comprising: (a) separating wood residue into first and second fractions; (b) directing the first fraction to a wood residue storage bin; (c) directing the second fraction to a wood waste products incinerator; (d) directing the first fraction from the wood residue surge bin to the incinerator as make-up during slack periods of feed of second fraction to the incinerator.

The first fraction from the wood residue surge bin can be directed on command from a programmed microprocessor to join the second fraction on a conveyor to the incinerator, according to incinerator operator temperature operating criteria. The first fraction from the wood residue storage bin can be directed to the incinerator by a conveyor.

The first fraction can comprise wood residue of a suitable size for storage bin and conveying operations and the second fraction can comprise wood residue greater than the first fraction in size. The line of division between the size of the first fraction and the second fraction can typically be anywhere up to about 30 centimeters (12 inches) in size. Anything larger tends to bridge and block the hopper. As a general rule, the first fraction can comprise wood residue of 10 centimeters (4 inches) in size or less, and the second fraction can comprise wood residue greater than about 10 centimeters (4 inches) in size. The dividing line is variable from mill to mill and can be adjusted to specific requirements.

Wood residue of larger than about 10 centimeters (4 inches) size can be reduced to less than 10 centimeters (4 inches) size to provide make-up if the volume of wood waste about 10 centimeters (4 inches) or less size is less than required.

The first fraction of wood residue can comprise shavings, wood sawdust and wood chips. The wood residue can include wood bark which can be separated into a third fraction and a fourth fraction, the third fraction being directed to the wood residue bin and the fourth fraction being directed to the conveyor to the incinerator.

The wood residue can include wood planar trim which can be separated into a fifth fraction and a sixth fraction, the fifth fraction being directed to the conveyor to the incinerator and the sixth fraction being directed to a wood chipper for recovery as pulp chips, or storage in the wood residue storage bins.

The wood residue can include yard lumber waste which can be separated into a seventh fraction and an eighth fraction, the seventh fraction being directed to a wood chipper and the eighth fraction being directed to the conveyor to the incinerator, or to the wood residue storage bin.

The wood residue can include mill log waste and yard log waste which can be separated into a ninth fraction and a tenth fraction, the ninth fraction being directed to a debarker, a portion of product from the debarker being directed to the wood chipper for pulp recovery and the remaining portion of the product from the debarker being directed to the conveyor to the incinerator, and the tenth fraction being directed to the conveyor to the incinerator, or to a wood residue hog and then to the wood residue storage bin.

The wood residue incinerator can be equipped with and monitored by an air flow sensor and control, an incinerator top damper control, a temperature sensor and control, and a fuel height sensor, the data from the sensor and controls being transmitted to a microprocessor which can be programmed to regulate air flow, and fuel height in the incinerator, and the incinerator top damper set time, according to a temperature set point and anticipated wood residue volumes to be incinerated.

The relative proportions of the first fraction, second fraction, third fraction, fourth fraction, fifth fraction, sixth fraction, seventh fraction, eighth fraction, ninth fraction and tenth fraction can be controlled by flow direction controls which can be monitored and regulated by the microprocessor, according to data obtained from the air flow control, damper control, temperature control and fuel height sensor of the incinerator, and anticipated volume of wood residue over a predetermined time.

Wood can be recovered from the first fraction and can be directed to a second wood residue storage bin. The level of first fraction in the wood residue storage bin and the level of recovered wood in the second wood residue storage bin can be monitored by respective level controls which transmit signals to the programmed microprocessor.

The microprocessor can be programmed according to a main program block, a menu module which can control access to a time table module and start and termination times for the process, a timing module which can contain a clock starting at the commencement of a work week and ending at the end of a work week, a sensor monitoring module which can monitor and store data from sensors connected to and distributed throughout the process, and cold start, day/night and close down modules which can control residue storage bin input/output activities, minimize low temperature incinerator burn time.

BRIEF DESCRIPTION OF THE DRAWINGS

In drawings which illustrate specific embodiments of the invention, but which should not be construed as restricting the spirit or scope of the invention in any way.

DETAILED DESCRIPTION OF SPECIFIC EMBODIMENTS OF THE INVENTION

Figure 1:
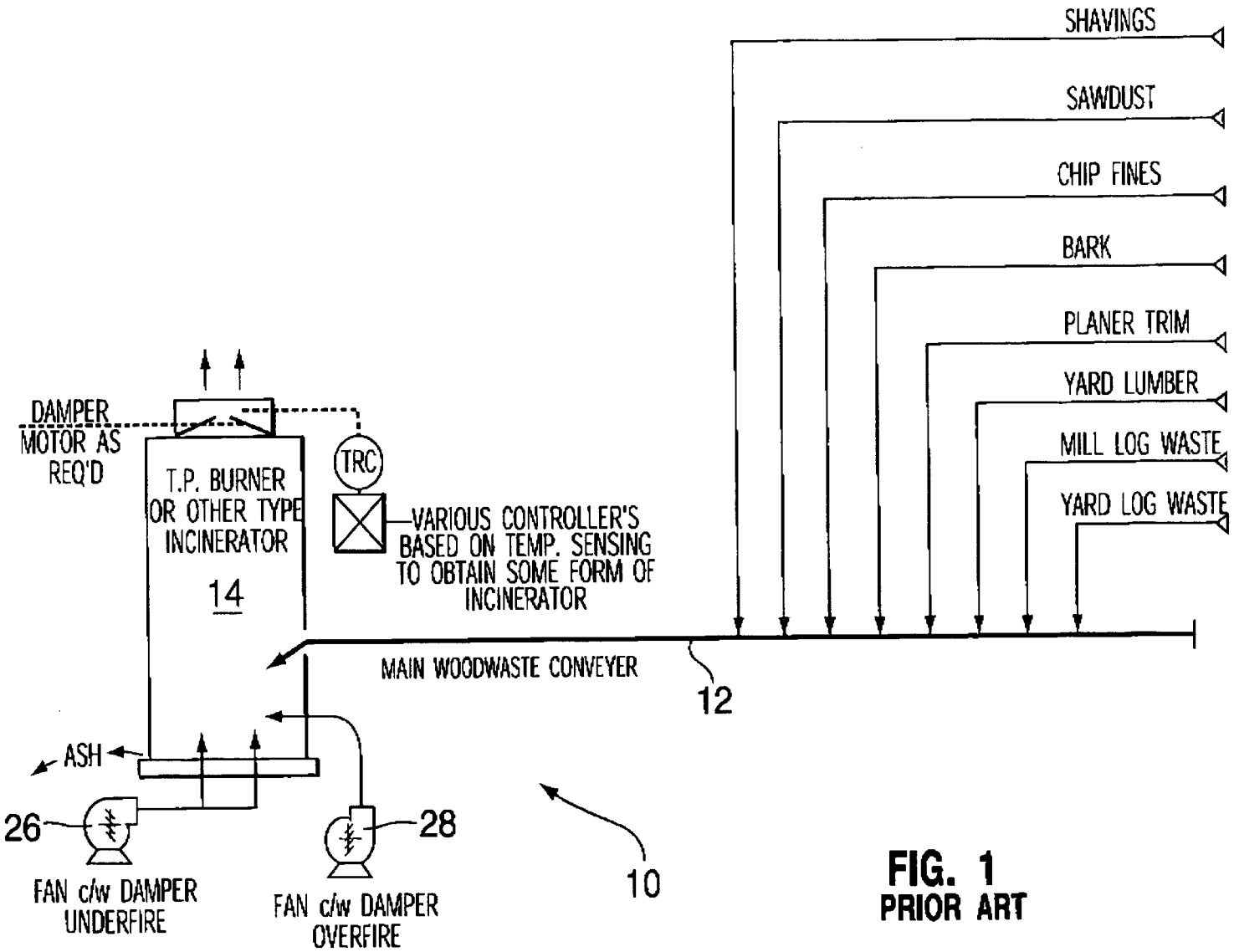
FIG. 1 PRIOR ART
FIG. 1 illustrates a traditional system of disposing of wood residue in an incinerator according to the prior art, where the incinerator is directly tied to the mill wood residue conveyor and the controls of the incinerator and the mill operation system are not integrated.

FIG. 1 illustrates a typical wood mill residue incinerator disposal system 10 according to the prior art. Waste wood products such as shavings, sawdust and chip fines, tree bark, planer trim from a wood planing mill, yard lumber waste, mill log waste and yard log waste, are all fed to the mill main wood residue collection infeed conveyor 12. The combined waste wood products are conveyed by the conveyor 12 to a typical fired waste wood products incinerator 14. Conventional controls such as air volume dampers on the air fan inlet or outlet, an incinerator top damper, controlled by manual or electrical means and a temperature recorder control (TRC), assist in operating the facility. It will be noted that the typical prior art process as illustrated in FIG. 1 incinerates all wood waste products regardless of value and there is no facility for recycling valuable waste wood products. A typical system 10 as described is usually sized and capable of handling maximum incinerating waste flows as produced by the mill in a given period during the day. Such prior art systems 10 are generally not efficient at lower than maximum waste flows and usually when the waste flow slows down from a maximum level the operating temperature of the incinerator drops off correspondingly. This results in inefficient combustion and excessive particulate discharge which are unacceptable by current environmental standards.

Figure 2:
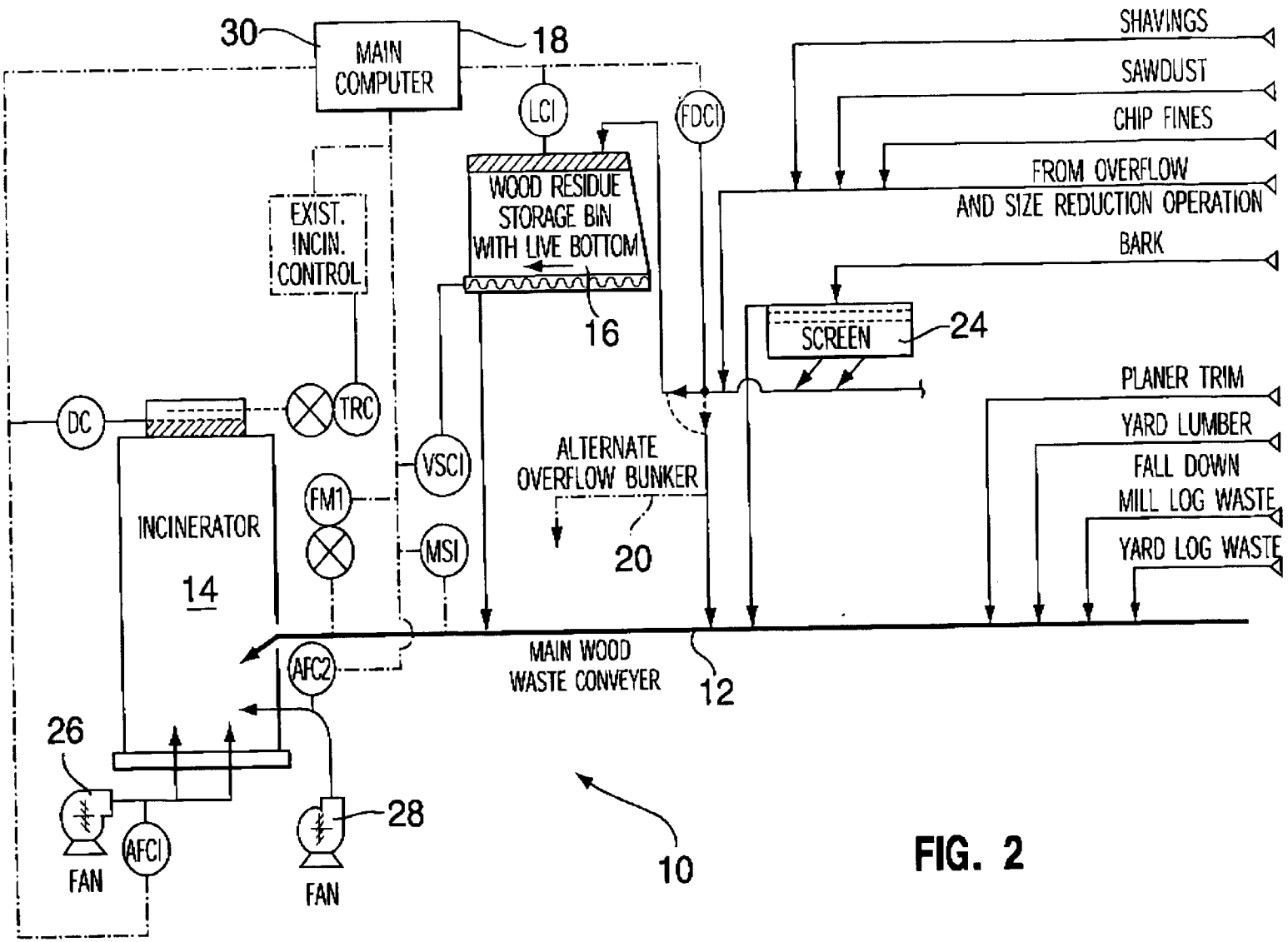
FIG. 2 illustrates a flow sheet for a basic system or minimum requirements per the flow diagram in FIG. 4 of a continuous six-day-per-week semi-independent wood residue incinerator disposal system with storage and control according to the invention, but without wood products recovery.

The basic system 10 of the subject invention is illustrated by FIG. 2. It represents a major improvement over the typical wood residue disposal system 10 as described above in association with FIG. 1 because it can efficiently deal with uneven wood residue flows and if desired, lends itself particularly well to recovering valuable wood by-products rather than incinerate them. All of this can be accomplished without incinerator operation upsets. In the system 10 according to the invention, fine material of suitable size for storage bin and conveyor operation comprising shavings, sawdust, chip fines and overflow are directed to a wood residue storage bin 16. Bark is screened and suitable size material is sent to the same wood residue storage bin 16. The fine material is stored in the wood residue storage bin 16 with a live bottom while coarse material is conveyed by the conveyor 14 to the incinerator 14 and burned directly. The dividing line between fine and coarse material can vary from mill to mill. As a general rule, the fine material can be any size that is suitable for storage in the bin 16 and for conveying. The dividing line can typically be up to about 30 centimeters (12 inches) because larger sizes tend to block the hopper openings. In typical operations, the dividing line between fine and coarse can be about 10 centimeters (4 inches). A steady stream of coarse wood residue fuel comprising planer trim, yard lumber, mill log waste and yard log waste, maintains the incinerator 14 within a specific temperature range. The fine residue is retained in the live bottom, or other, wood residue storage bin 16 for feeding into the incinerator 14 during mill downtimes, as will be described in more detail below. Usually there is an adequate supply of fine residue material available to allow for enough storage against times of mill stoppage. However, if this is not true for some mill operations, then a size reducer such as a wood residue hog may be installed at additional cost, to process some of the larger residue to smaller size suitable for storage in the wood residue storage bin 16.

A central computer program 18 through a programmable logic control (PLC) system controls all residue handling and incinerator activities. The computer program 18 stores data such as shift schedule, lunch and coffee breaks, time between shifts, average mill downtime, wood species mix, and other relevant data. The computer program 18 uses this data in operating the overall wood residue storage and disposal system. Nonscheduled production problems can also be dealt with. They are evaluated as they occur and are electronically and/or manually loaded into the computer program 18, which then assimilates the data.

The computer program 18 also monitors storage bin residue levels, incinerator fire core size, various incinerator temperature points, the volume of wood residue being delivered to the incinerator, moisture content of the wood waste, and other critical performance variables.

Utilizing the information obtained from these various sources and correlating the information in its program, the computer program 18 through the PLC builds excess fine residue capacity in the storage bin 16 at appropriate times and disposes of the fine waste at appropriate times such as during lunch breaks, between shift schedules, and the like, with the objective of maintaining the incinerator 14 at peak operating temperature, which in turn minimizes undesirable emissions. The computer program 18 is capable of overriding the normal incinerator control system, including the top damper controls (DC) and the air venting fans in order to dispose of the waste in the most efficient and high performance manner possible. But even more importantly, the computer program 18 slows down or increases the burning process to correspond to anticipated mill production changes. Conventional incinerator wood disposal systems 10 experience large fluctuations in operating temperatures due to surges of wood waste at certain times, and drops or stoppages in flow of wood waste at other times, such as during lunch and coffee breaks, and shift changes. These extreme fluctuations in temperature lead to surges in carbon monoxide and other noxious gas emissions and surges in environmentally damaging flue ash. It is a well-established and documented fact that consistent incinerator temperature control above a set minimum temperature is a main key to efficient non-polluting burner operation. The system 10 according to the invention carries this out.

Basic System—Without Wood Residue Recovery as Illustrated in FIG. 2

The basic invention, while best applied to new mill installations, is concerned to a high degree with retrofitting into existing mill residue output and incinerating systems 10, by using as much of the existing equipment as possible, to allow for the lowest cost installation.

In evaluating the installation of the basic system 10 into an existing mill facility, a thorough investigation of the existing incinerator 12, waste conveyors 12 and mill conditions on site is conducted as follows:

- An analysis of wood residue type, quality, moisture content, total volumes and rate of residue production, hours and shifts per day and days per week and per year of operation is conducted.
- A general analysis of the mill residue outfeed conveying system is conducted.
- A careful incinerator analysis for make and type and operating details, to determine its degree of adaptability to the invention is conducted. This requires, amongst other criteria, an incinerator turndown ratio of 2:1 or better (a turndown ratio of 2:1 means that the incinerator 14 can burn just as efficiently at half the normal residue volumes, as it can at full volume). If this is not possible, then the incinerator 14 may require rebuilding, or replacement by a properly sized unit or, if waste wood volumes are adequate, then lower turn down ratios may be acceptable through proper storage bin sizing.
- A check of the incinerator 14 for minimum required ancillary equipment, such as (1) having an underfire and overfire air supply system properly sized and in good condition, with either manual or auto controls (AFC); and (2) a proper operating top damper system in good condition with operating control (DC).

Once the above analysis is completed, the invention may be adjusted, designed and engineered to integrate into the usable equipment of the existing mill facility.

Basically, the system according to the invention comprises the following main components. Firstly, a live bottom, or other, wood residue storage bin 16, augmented by an overflow storage bunker 20 for emergencies is included. The bin 16 is designed and sized to hold enough residue wood product fuel to allow a suitable incinerator 14 to burn twenty-four hours per day, five or six days per week, based on typical mill production. Unlike other systems 10, the system 10 according to the invention requires only one incinerator shutdown and start-up per week. The system 10 according to the invention also leads to much more efficient control over wood waste disposal and minimizes generation of noxious gases and undesirable ash emissions. Additional storage bins can be added if certain types of wood residue materials are to be collected and used for other products either on or off site. This is possible without incinerator upset or excess environmental problems.

Secondly, an overall control computer program 18 operating through a sophisticated programmable logic control, (PLC) system is included. This provides for the sensing, controlling and diverting of wood residue flows to and from the residue storage bin 14 and/or to the incinerator 14 unit, and if desired, to various value-added product recovery storage bins 22. The computer program 22 is loaded into the suitable PLC system, and is compatible with and can integrate and receive data from existing mill production controls and provide both sensing and override control function capability for the separate individual incineration control systems. This results in the computer program 18 having final overall control of the wood waste incineration system and incinerator burner turn down ratios.

FIG. 2 will now be discussed in detail. FIG. 2 illustrates a schematic flowsheet of a basic system 9, mill wood residue disposal apparatus and process according to the invention.

Wood waste materials such as shavings, sawdust and chip fines which due to mill processing are typically smaller than about 10 centimeters (4 inches) in size, are respectively directed along with any overflow materials from size reduction operations through the computer controlled flow direction control, (FDC) to either the wood residue storage bin 16 with live bottom, or the main wood waste conveyor 12 and then on to the incinerator 14. Bark is another waste product and is screened, with all smaller bark material being directed by the flow direction control (FDC) to either the wood residue storage bin 16 or the main wood waste conveyor 12 and ultimately to the incinerator 14. All oversize bark from the screen 24 (typically greater than 10 centimeters (4 inches) in size), is transported directly to the main wood waste conveyor 12 and then on to the incinerator 14.

In most cases, the screened bark, shavings, sawdust and chip fines are in sufficient volume to allow all other mill wood waste such as planer trim, yard lumber waste and mill and yard log waste to be transported directly by the main wood waste conveyor 12 to the incinerator 14. However, if this is not true in a specific installation, then a portion of this latter waste can be sent through a size reducer, such as a wood hog, not shown, with the reduced size material suitable for storage bin operation being directed to the storage bin 16 through the computer controlled flow direction control (FDC).

Of the various storage bin types available for use in this invention, the live bottom wood residue storage bin 16 is generally superior. The bin 16 is equipped at the top with a distribution conveyor, which spreads the waste fuel more or less evenly into the bin 16. The bin 16 has a live bottom which is operated by hydraulic rams or other means. These push the fuel into a conveyor at one end of the bin 16. Both the conveyor and the hydraulic rams are controlled by the variable speed control (VSC), the main computer program 18 and the PLC, to either allow fuel to flow or not to flow, to the main wood waste conveyor 12.

The bin 16 is furthermore equipped with a level control (LC), which senses and obtains data on a constant basis, the total fuel level and volume contained in the bin 16. The level and volume data is sent to the computer program 18 in the PLC for constant monitoring and control purposes.

A flow measurement sensing device (FM) is installed into the main wood waste conveyor 12 at a location just prior to the inlet into the incinerator 14. The measured flow data is transmitted to the computer program 18 in the PLC for constant monitoring and control purposes. The computer program 18, by sensing high incinerator temperatures, will reduce the amount of fuel being conveyed to the incinerator 14 as measured by the flow sensor (FM) and send more fuel to the storage bin 16. On the other hand, if incinerator 14 temperature drops, the reverse occurs. If the storage bin 16 is close to being filled, the high temperature in the incinerator 14 may be brought down, through the computer program 18, by adding more cooling air to the incinerator 14 or slowing down the fuel burn rate, by the manipulation respectively of the incinerator overfire and underfire airflow controls (AFC).

A moisture sensor (MS), installed on the main wood waste conveyor, senses the degree of moisture content in the waste wood material. The moisture content will affect the incinerator burning temperature. The higher the moisture content, the lower the final temperature, all other criteria being equal. The reverse is true with lower moisture content. The moisture sensor (MS) signal data is therefore sent to the computer program 18 for monitoring and control purposes.

The incinerator 14 is equipped with a number of computer-program-controlled controls as well as sensing devices, all of which return data to the computer program 18 thereby ensuring that the incinerator 14 operates at peak efficiency, notwithstanding surges and drops in wood waste production from the mill.

Apart from the incinerator's 14 own temperature control, a temperature recording control (TRC) is mounted at the top of the incinerator 14 to transmit temperature data directly to the computer program 18 on a constant basis. Controlling the temperature above a certain minimum is one of the key elements in ensuring that noxious gases and particulate ash load emissions in the incinerator exhaust is kept to within environmental standards and limits.

The damper control (DC) at the top of the incinerator is either existing in the incinerator's 14 own control system or added to the facility by the new invention and will control the flue gas exhaust volume rates.

The flow of waste materials is directed into the incinerator 14 by the main wood waste conveyor 12 at approximately a mid-height elevation. The materials then drop down onto the incinerator fuel pile at the bottom interior of the incinerator 14. The incinerator burning efficiency can be further enhanced by the installation of a fuel pile height sensor (FHS) (not shown in FIG. 2), located in the lower region of the incinerator 14. The file pile height sensor (FHS) relays to the computer program 18 information as to fuel height or ash accumulations in the latter part of a particular operations week and, coupled with temperature moisture readings and anticipated fuel volumes expected, enables control of the rate of wood incineration and ensures optimum performance.

The bottom region of the incinerator 14 has two different sets of air supply fans 26,28. The bottom fan 26 set provides underfire air, which is blown up through the base of the incinerator 14 through appropriate discharge nozzles and is controlled by airflow control #1 (AFC1). This AFC1 also senses the rate of airflow and returns this data back to its own incinerator control and to the master computer program 18. Likewise a second fan 28 set provides for overfire air, which is blown into the sides of the incinerator 14 in a counterclockwise direction.

The underfire air volume determines to a large degree the rate at which the wood waste fuel will be burned. The overfire air provides for adequate amounts of air needed to (a) fully combust the wood particles and the hot gases leaving the burning wood waste pile, and (b) provide for some cooling air at the sides and top edges of the incinerator walls.

The invention further comprises a laptop computer 30 which stores the computer program 18 with sufficient RAM memory, a suitable monitor and hard and floppy drives to enable it to upload the PLC and program it to do the overall wood residue sizing, storage and flow direction program, along with being capable of receiving and acting upon all system measured sensing data and be fully programmed to act upon the overall requirements of the semi-independent wood residue disposal system 10.

All of the computer real time process inputs and outputs are processed through the programmable logic control (PLC) system. The PLC, through a proper serial output and suitable printer, prints a daily and weekly operations report and as well prints out any program changes or revisions and other computer maintenance criteria.

Thus, the computer program 18 controls the amount and rate of wood waste conveyed into the incinerator 14 by either releasing fuel into or out of the storage bin 16 as required. The computer program 18 also controls the rate of wood waste incineration by controlling the amount of underfire and overfire air delivered to the incinerator base area, and optimizes the optimum incinerator top damper setting. Then, in turn, by factoring in the incinerator fuel pile height and fuel moisture data, and anticipated wood waste volumes to be incinerated for that day, the program assures that the incinerator 14 is maintained at optimum incineration conditions at proper temperatures. All of this results in minimum noxious gas and particle ash emissions while at the same time allowing for adequate wood waste storage volumes for the last shift of the day incinerator operation.

Figure 3:
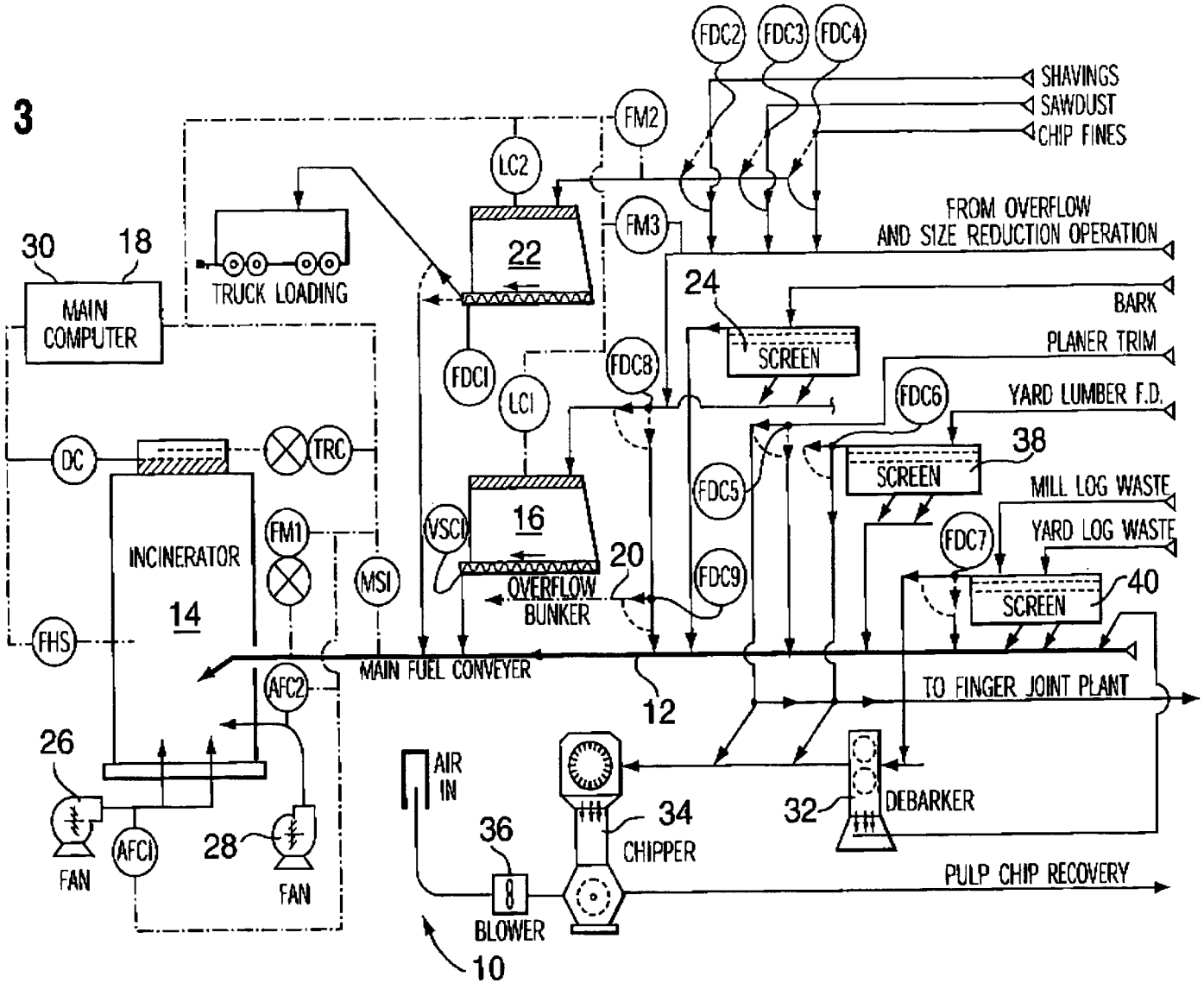
FIG. 3 illustrates a more elaborate system (than the one shown in FIG. 2) including wood residue products recovery, and continuous six-day-per-week, semi-independent wood residue incinerator disposal system with storage and control according to the invention.

Enhanced Basic System—With Wood Residue Recovery as Illustrated in FIG. 3

The invention lends itself especially well to enhancements utilization in wood residue recovery. This occurs where valuable wood residue suitable for use in the manufacture of other composite products, needs to be removed from the main waste wood stream as it is produced by the mill process. In the enhanced system 10, an additional wood residue recovery storage bin 22, or bins, is or are required, to store the recovered wood materials. Some additional flow direction controls or diverters are also required to separate the desired residue materials from the rest of the waste.

Some recovered wood materials such as pulp chips do not require a storage bin but do require additional equipment such as wood material sizing screens, a debarker 6, a pulp chip chipper 34 and a high pressure blower 36 conveying system to transport the chips to existing mill chip screens. The same basic computer program 18 and PLC system can be used, but with the program enlarged and modified to incorporate the enhancement.

FIG. 3 illustrates a schematic flowsheet of the enhanced woodmill basic system 10 with incinerator disposal apparatus and process according to the invention, with recovery of various wood residues incorporated in the process.

The basic system equipment control and workings are as described earlier in association with FIG. 2. To recover various quantities of the white wood from the waste wood materials comprising shavings, sawdust and chip fines, the main computer program 18 directs the flow direction controls FDC2, FDC3 and FDC4 to either transport the materials to the additional installed wood residue recovery storage bin(s) 22 for later truck shipment, or to the first wood residue storage bin 16 for subsequent incineration.

A level control and sensor (LC2) is installed on the recovery wood residue storage bin 22 also, to control, through the main computer program 18, the level of recovered wood material in the bin 22. The level control (LC2) also acts as a high level shutoff or alarm, to prevent or warn of bin overfilling.

Flow measuring sensors FM2 and FM3 measure the flow of material being delivered to the recovery wood residue storage bin 22 and the wood storage bin 16, respectively. The flow measuring data is transmitted to the main computer program 18 for monitoring and control purposes. This includes an indication of the quantity of white wood that has been recovered and removed from the incineration process. Such recovery may require substitution of fuel from the wood residue storage bin 16.

The recovery wood residue storage bin 22, as previously recommended, is equipped at the top with a distribution conveyor, spreading the material evenly in the bin 22. It is also equipped with a live bottom which is operated by hydraulic rams, or other means, for pushing the fuel into a conveyor, which is controlled by the main computer program 18 to either start or stop the bin outflow.

The flow direction control (FDC1) is controlled by the main computer program 18 to either direct the white wood material to a truck loading station for transport to other products, or to the main fuel conveyor 12 to assist in keeping the incinerator 14 operating at proper temperature.

Additional wood waste materials may also be recovered from the mill residue as follows. Planer trim may be direction controlled by the computer program 18 through flow direction control (FDC5) to either flow to the main fuel conveyor 12 or be recovered as pulp chips by passing the planer trim through a chipper 34.

Yard lumber may be recovered from yard lumber movement operations. The yard lumber is cleaned of dirt and gravel through a "grizzly" screen 38 and through flow direction control (FDC6) is directed either to the main fuel conveyor 12 or is recovered as pulp chips by passing them through the chipper 34.

Mill log waste and yard log waste is cleaned of dirt and gravel by feeding them through a "grizzly" screen 40. The cleaned waste is directed through flow direction control (FDC7) to either the main fuel conveyor 12 or to a rosser head type debarker 32, which removes all of the bark. It is then directed to the main fuel conveyor 12 or the debarked wood material is fed to the chipper 34 for pulp chip recovery.

A high pressure blower 36 conveys the pulp chip material from the wood chipper to the existing mill chip screening system and further processes it to existing chip storage bins.

If required, any of the waste materials larger than a suitable size for bin or conveying operation, such as planer trim, yard lumber falldown and mill and yard log waste, may be directed by the computer program 18 through additional flow direction controls to a heavy duty "size reducer" or wood hog (not shown), which will reduce the wood material to suitable size for use as additional wood residue material suitable for storage.

Flow direction controls (FDC8) and (FDC9), as signalled by the computer program 18, direct fuel residue to either the wood residue storage bin, or to the overflow bunker 20 (to be used only in emergencies), or to the main fuel conveyor 12 for direct feeding into the incinerator 14.

As illustrated by FIG. 3, which illustrates a more elaborate system 10, the system 10 according to the invention is capable of isolating or screening out specific fibers, without upsetting incinerator combustion and burning operations, that have value for the production of certain forms of products such as MDF and particle board, etc. This is profitable and very effective, particularly if the waste product volume from two or three regional wood waste disposal facilities is combined.

The system 10, properly designed according to the invention, furthermore provides an opportunity to debark broken and short log ends and other solid waste and produce usable fibers, again without starving the incinerator 14 since other waste of poorer quality may be substituted out of the storage bin 16, or through the unique computer program override control by decreasing the rate of burning in the incinerator 14 during such fiber recovery periods, or by doing both.

Program Design

Figure 4:
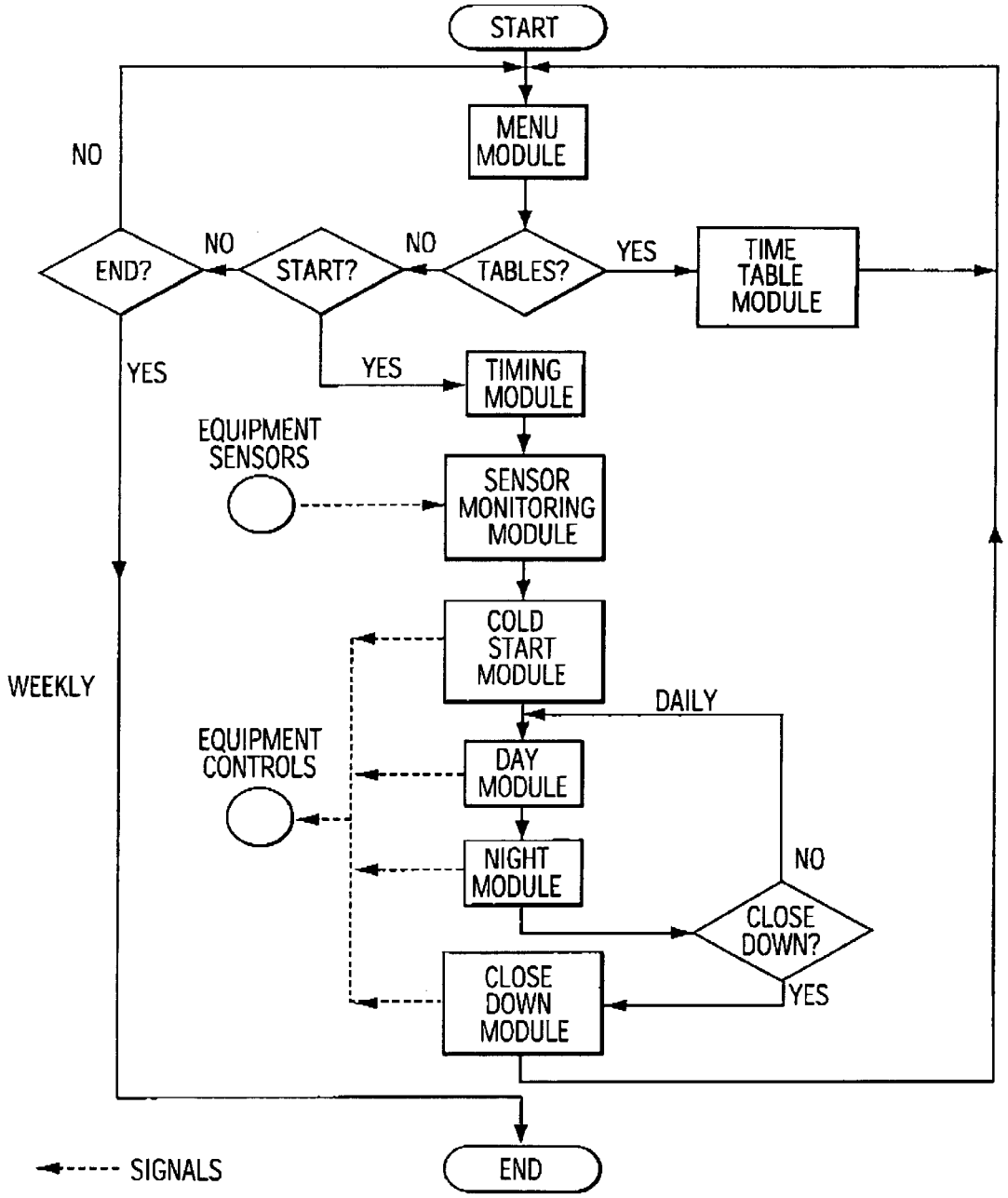
FIG. 4 illustrates a flow diagram showing the main computer program block for a semi-independent wood residue disposal system according to the invention.

FIG. 4 illustrates as part of the invention a flow diagram for the mill semi-independent waste wood disposal recovery computer program (main program block).

The computer program system 18 has a modular programming approach using a high level language such as C++. This highly modular approach pays off in expediting design for existing or new facilities, detail programming debugging and testing. It also permits easy installation and maintenance at various sites with differing existing incinerator operating equipment.

The components shown schematically in FIG. 4 comprise a number of modules which together make up the main program block. The main program block exerts overall control of the program 18 and calls and exits the individual modules that perform specific functions. The individual major modules may contain many smaller modules with hundreds of lines of code.

Menu and Time Table Modules

The menu module controls access to the Time Table module and starts/terminates the entire program. The Time Table Module enables the operator to enter and vary the program 18 to take into account coffee breaks, shift timings and allow for statutory holidays, etc. This data is used by the Timing Module.

Timing Module

The timing module contains a clock start which is typically programmed to one hour prior to start time on a Monday morning. The clock runs all week. The timing module is accessed by the Modules below the Sensor Monitoring module for timing various actions.

Sensor Monitoring Module

The Sensor Monitoring Module constantly monitors and stores data from all sensors connected to the waste disposal system 10 (see FIGS. 2 and 3) and makes this data available to all modules below it.

Cold Start, Day/Night and Close Down Modules

The Cold Start, Day/Night and Close Down Modules control residue storage bin 16 input/output activities and eliminate low temperature burn time, except at close down. These Modules are programmed to contain the "rules" required to run the system 10 for each specific installation.

System Advantages

The main advantages of the semi-independent mill residue disposal system 10 according to the invention are:

Firstly it is able to control incineration rate, and/or other waste disposal criteria, independently from mill production. In the past, waste residue disposal has been linked directly to mill production, which usually fluctuates widely. Thus, it has been impossible to operate the incinerator 14 at maximum efficiency and within environmental regulations at all times.

Secondly, it permits tighter control to be exercised over rate of waste disposal, thereby allowing the incinerator 14 to operate continuously and much more efficiently within typical Department of Environmental and other regulatory guidelines and regulations relating to temperature requirements and particle count discharge for wood product manufacturing facilities. Providing that the incinerator to be used is properly equipped, or allowed to be adapted, to proper exhaust pollution control equipment as required.

Thirdly, it allows for continuous incineration operation, 24 hours per day with only one shutdown per week for most operations. It is also able to accommodate breaks between shifts (even up to ten hours or more), coffee breaks and lunch hours, and other slow downs and delays, which have been a constant hindrance to efficient incinerator operation in the past. Even unscheduled maintenance of short durations, does not cause incinerator operating upsets or disturbances.

Fourthly, it prevents the occurrence of dangerous overheated incinerator conditions. These can occur when there are surges in residue fuel feeds. Such conditions in conventional systems have caused costly mill fires and have led to reduced incinerator operating life.

Finally, the invention is especially adept in allowing the removal of wood residue suitable for recovery into other products, directly from the mill waste residue stream, without upsetting incinerator operations, by substituting fuel from its residue storage bin.

System Design

The system 10 according to the invention is compatible with existing wood product manufacturing mills because the system 10 uses existing available technology, is realistic in design, operations and cost, provides for various waste disposal incinerator types, provides for alternate value added product mill residue extraction, and has one central computer control system.

Sizing of Storage Bin—Live Bottom Type

The size of the live bottom fuel storage bin 16 system is critical and is to be carefully sized and must include for the special computer 18 program according to the invention and be large enough to store sufficient diverted shavings, sawdust, chip fines and bark, all of less than 10 centimeters (4 inches) in size, to accommodate the following additional conditions for a two shift/day operation:

1. Allow for an average of eight hours of mill non-production (at medium burning capacity);
2. Allow for four extra hours of additional fuel burn, which may be required to deal with winter conditions, wet wood or summer conditions, and dryer wood;
3. Allow for reduced shift production hours, at minimum burn; and
4. Allow for two hours extra fuel capacity as a contingency reserve.

In general, a fourteen hour fuel storage capacity bin at medium burn rate, or a twelve hour fuel storage capacity at full burn rate is likely to be a preferred system for most mills operating two shifts per day. Larger capacity bins to provide up to twenty hours storage capacity will be required for continuous incinerator operation, for single eight hour shift per day operating mills. The alternative is to reduce the incinerator size.

Wood Residue Recovery Flow Control

The wood residue flow from the mill that is not directed ultimately to the incinerator 14, for example, the truck loading option at the upper left of FIG. 3 or the chip recovery procedures at the lower right of FIG. 3, can be separated and diverted into one or more of the following areas for:

1. Fuel pellet manufacturing;
2. Decorative bark manufacturing;
3. Dry-kiln/building heating system;
4. Alternate products (pulp) manufacturing;
5. Alternate products (panel board) manufacturing;
6. Co-generation (heat and electricity) system.

Any storage of wood residue other than that used for incineration, will require additional live bottom storage bins. If any mill residue is to be recovered, then the existing incinerator 14 should be checked for proper size or increase its "turn down" ratio.

In operating a system 10 according to the invention, using existing incinerator size, it is advisable to determine priorities for the use of the stored wood residue. That is, when a proper environmentally approved incineration is a first priority, then all stored wood residue, no matter what its allocation, must be on call for incinerator fuel use if a shortage develops in a particular twenty-four hour period.

ELECTRONIC AND INSTRUMENT EQUIPMENT

Control System Components

Programmable Logic Control (PLC)

An Allen Bradley PLCT™ is suitable because it readily adapts to the invention and consists of a PLC-5/40 or PLC-5/60 processor depending on system memory requirements, complete with a power supply, RS232/423/422 communication ports, up to 4 remote Input/Output (I/O) ports, up to 64k Word memory modules and various type and number of I/O 1771 modules as required. Modules will have a variety of inputs or outputs such as for direct thermocouple or RTD temperature inputs of 0–5 and 4–20 mA current input or output signals, etc. Most PLC components are rack mounted for a central located control enclosure mounting. Remote I/O is mounted appropriately at mill operation locations.

Programming Computer

A standard industrial hardened laptop computer 30 at Pentium speed can be used to program the Allen-Bradley PLC processor or use the Allen-Bradley T-53 industrial programming terminal for the same purpose.

Software Computer Programs

The software computer program 18 computes:

(A) The basic control program in accordance to the invention plus additional programming for the unique mill application required depending on existing equipment and control systems to be utilized. FIG. 4 illustrates the program in a control flow chart format. The program is written in C++™ programming language.

(B) Suitable PLC software programs available from Allen-Bradley to integrate all programming, suitable for Allen-Bradley PLC applications.

Temperature 7 Day Chart Recording Control (TRC)

The temperature recording control (TRC) can be a Honeywell instrument complete with a proportional, integral and derivative (P.I.D.) control, 4–20 mA output, range 0–1600° F., thermocouple type K input and 115 Vac operating voltage. Alternatively, the sensing may be accomplished by a Rosemount Mod.#244P temperature transmitter, range 0–1600° F. and 4–20 mA output to the recorder controller.

Bin Level Sensing Controls (LC)

A Milltronics AIRANGER IV solids level control (LC) with up to 60 bin points capacity, output 4–20 mA analogue, #AO-15, range to 60 meters, ambient temperature range −40° F. to 100° F., 115 Vac operating voltage and complete with air temperature sensor is suitable for use with the invention.

Flow Measurement (FM)

A continuous in-line weighing single idler belt scale, Milltronics MSI model, suitable for belt conveyors of 500 mm to 1800 mm in width, complete with load cells, output module and compu-M belt scale integrator, with either analogue 4–20 mA or digital output, 115 Vac operating voltage, is suitable for use with the invention.

Variable Frequency Speed Control (VSC)

An Allen-Bradley bulletin #1333 for a 10 HP three phase induction motor rating, constant torque, control interface for Allen-Bradley PLC can be used.

Damper Control (DC) and Airflow Control (AFC)

Both the damper control (DC) and the airflow control (AFC) are typical readily available damper control motors of proper torque size, with feedback control loops for positioning control, manufactured by Honeywell and others. They require proper sizing for torque and speed as demanded by the particular incinerator type and size.

Moisture Sensor (MS)

A non-contacting moisture sensor (MS) with analogue output signal of 4–20 mA, range 5% to 60% moisture content (wet basis), suitable for ambient temperatures of −40° F. to 100° F. can be used. Such moisture sensors are commonly available from several manufacturers specializing in moisture and humidity controls.

Flow Direction Control (FDC)

The flow direction control (FDC) can either be based on electrical or hydraulic fluid ram/cylinder movement control, complete with feed back positioning signal, open/closed switch control system, available from a number of machine shops and suppliers.

Incinerator Fuel Height Sensor (FHS)

A photoelectric sensing device made up of an array of four individual sensors adapted for high temperature applications with on-off output signal and self test monitoring and a range of up to 100 ft. distance is suitable.

MECHANICAL EQUIPMENT

| | |
|---|---|
| Live Bottom Storage Bins | |
| Manufacturer: | Hallco Manufacturing Co.<br>Interior Mill Equip.- Manufacturer |
| Mill Log and Lumber Waste Grizzly Screens and Classifiers | |
| Manufacturer: | Rader Canada<br>Valon Kone/Brunette (Deal Processor) |
| Wood Material Sizing Screens | |
| Manufacturer: | Rader Canada, RDS-Disc Screen |
| Debarker and Drum Debarkers | |
| Manufacturer: | Valon Kone<br>Nicholson<br>HMC Corp. (Rosserhead Debarker, Mod #V2110)<br>CAE/Fuji-King Debarker #KD3/30D |
| Waste Wood Chippers | |
| Manufacturer: | Nicholson Manufacturing,<br>waste wood Disc or Drum Chipper |
| Hi Pressure Blow Conveying System | |
| Manufacturer: | Rader Canada<br>Pneuco Sales |
| Wood Waste Grinders | |
| Manufacturer: | CBI Grizzly Mill #48x36<br>Bandit Industries Inc.<br>Model #3680-Beast Recycler<br>West Salem Machinery - High Inertia Hog<br>Kimwood Manufacturing - KIMWOOD Hog |
| Conveying Equipment | |
| Manufacturer: | By various machine shops and manufacturers according to capacity and length specifications.<br>Belt conveying<br>Chain conveyors, various<br>Chain Link conveyors |

Typical Daily Operations Program

The system 10 is typically programmed for a sixteen hour per day, two shifts per five day week operation. It may also be programmed for one shift per 5 day week operation, with increased residue storage bin size.

A Typical Monday Morning Start-up Schedule (for a Two Shift, Sixteen Hour/Day Mill Operation)

The first requirement is to replenish the bin storage level to maximum without dropping the incinerator temperature below 1000° F., which is the minimum efficient incinerator operating temperature.

Hour—1 Move the fuel into the incinerator 14 from the storage bin 16.

Hour—30 min. Start up the incinerator fire.

Hour 0 Start up mill production.

Hour 1 Cut back and control fuel flow from the bin 16 and move all the mill production waste to the incinerator 14 in order to gain a fuel burning pile of good operating size.

Hours 2, 3 & 4 Cut back the fuel from the mill to the incinerator 14, to a minimum amount but not less than the volume of all oversize waste residue.

Hold the incinerator temperature to a set point of 1000° F. by adjusting all incinerator controls to a minimum burn level.

Continue to replenish the fuel level in the fuel burn at a steady rate.

Use an anticipatory control (P.I.D. control).

Hours 5, 6 & 7 Continue the above procedure for hours 2, 3 and 4, but making adjustments for coffee breaks, the lunch hour and unforeseen production stop-pages.

Hour 8 Adjust the incinerator 14 between shifts to minimum burning but keep the incinerator temperature at 1000° F.

Hours 9–16 (incl.)

Same procedure as above.

Hours 17–24 (incl.)

Take fuel flow from the storage bin 16 only while keeping incinerator controls to a minimum and incinerator temperature at a minimum of 1000° F.

On the next day, and following working days, repeat the above procedures, except for the incinerator start-up. The incinerator 14 will be operating at minimum temperature. At the end of the work week, the system 10 is shut down. The weekend shutdown allows for cleaning and maintenance of the incinerator 14 and any of the material handling equipment that may require attention.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A process of efficiently disposing of wood residue from a solid wood product manufacturing mill comprising:

(a) separating wood residue into first and second fractions;

(b) directing the first fraction to a wood residue storage bin;

(c) directing the second fraction to a wood waste products incinerator;

(d) during periods of slack feed of the second fraction to the incinerator, directing a portion of the first fraction from the wood residue storage bin to the incinerator as make-up.

2. A process as claimed in claim 1 wherein the second fraction comprises wood residue greater in size than the wood residue of the first fraction.

3. A process as claimed in claim 2 wherein the first fraction comprises wood residue with a diameter of about 4 inches in size or less, and the second fraction comprises wood residue with a diameter of greater than about 4 inches in size.

4. A process as claimed in claim 3 comprising a further step of reducing wood residue with a diameter of larger than 4 inch size to a diameter of less than 4 inch size if the volume of the first fraction stored in the wood residue storage bin is less than required to allow portions of the first fraction to be directed to the incinerator as make-up during periods of slack feed of the second fraction to the incinerator.

5. A process as claimed in claim 1 wherein the second fraction is directed to the incinerator on a conveyor and the make-up portion of the first fraction, on command from a programmed microprocessor, is directed from the wood residue storage bin to join the second fraction on the conveyor.

6. A process as claimed in claim 5 wherein the incinerator is equipped with and monitored by an air flow sensor and control, an incinerator top damper control, a fuel height sensor, and a temperature sensor and control, the data from the sensors and controls being transmitted in association with a computer program of anticipated wood residue volume input to a microprocessor which is programmed to regulate air flow and fuel height in the incinerator and the top damper setting.

7. A process as claimed in claim 5 wherein the microprocessor is programmed according to a main program block, a menu module which controls access to a time table module and start and termination times for the process, a timing module which contains a clock starting at the commencement of a work week and ending at the end of a work week, a sensor monitoring module which monitors and stores data from sensors connected to and distributed throughout the process, and cold start, day/night and close down modules which control residue storage bin input/output activities, and minimize low temperature incinerator burn time.

8. A process as claimed in claim 1 wherein the second fraction is directed to the incinerator by a conveyor and wherein the make-up portion of the first fraction is directed from the wood residue storage bin to the incinerator by joining the second fraction on the conveyor.

9. A process as claimed in claim 8 wherein the first fraction of wood residue comprises shavings, wood sawdust and wood chips.

10. A process as claimed in claim 9 wherein the wood residue includes wood bark and comprising the further step of separating the wood bark into a third fraction and a fourth fraction, the third fraction being directed to join and become part of the first fraction in the wood residue storage bin and the fourth fraction being directed to join and become part of the second fraction on the conveyor.

11. A process as claimed in claim 10 wherein the wood residue includes wood planar trim and comprising the further step of separating the planar trim into a fifth fraction and a sixth fraction, the fifth fraction being directed to join and become part of the second fraction on the conveyor and the sixth fraction being directed to a wood chipper for recovery as pulp chips or subsequent storage in the wood residue storage bin as part of the first fraction.

12. A process as claimed in claim 11 wherein the wood residue includes yard lumber waste and comprising the further step of separating the yard lumber waste into a seventh fraction and an eighth fraction, the seventh fraction being directed to join and become part of the second fraction on the conveyor and the eighth fraction being directed to a wood chipper for recovery as pulp chips or subsequent storage in the wood residue storage bin as part of the first fraction.

13. A process as claimed in claim 12 wherein the wood residue includes mill log waste and yard log waste comprising the further step of separating the mill log waste and yard log waste into a ninth fraction and a tenth fraction, the ninth fraction being directed to join and become part of the second fraction on the conveyor and the tenth fraction being directed to a debarker, a portion of product from the debarker being directed to join and become part of the second fraction on the conveyor and the remaining portion being directed to the wood chipper for recovery as pulp chips or subsequent storage in the wood residue storage bin as part of the first fraction.

14. A process as claimed in claim 13 wherein the proportions relative to one another of first fraction, second fraction, third fraction, fourth fraction, fifth fraction, sixth fraction, seventh fraction, eighth fraction, ninth fraction and tenth fraction are controlled by flow direction controls which are monitored and regulated by the microprocessor, according to data obtained from the air flow control, damper control, temperature control and fuel height sensor of the incinerator, and anticipated volume of wood residue over a predetermined time.

15. A process as claimed in claim 1 wherein the incinerator is equipped with and monitored by an air flow sensor and control, an incinerator top damper control, a temperature sensor and control, and a fuel height sensor, the data from the sensors and controls being transmitted to a microprocessor which is programmed to regulate air flow, and fuel height in the incinerator, and the incinerator top damper set time, according to a temperature set point and anticipated wood residue volumes to be incinerated.

16. A process as claimed in claim 1 wherein, prior to the first fraction reaching the wood residue storage bin, some wood is recovered from the first fraction and is directed to a second wood residue storage bin instead of to the first wood residue storage bin.

17. A process as claimed in claim 16 wherein the level of first fraction in the first wood residue storage bin and the level of recovered wood in the second wood residue storage bin are monitored by respective level controls which transmit signals to a programmed microprocessor.

* * * * *